US009499882B2

(12) United States Patent
Wallace et al.

(10) Patent No.: US 9,499,882 B2
(45) Date of Patent: Nov. 22, 2016

(54) STRAIN-DETECTING COMPOSITE MATERIALS

(75) Inventors: Terryl A. Wallace, Yorktown, VA (US); Stephen W. Smith, Newport News, VA (US); Robert S. Piascik, Williamsburg, VA (US); Michael R. Horne, Yorktown, VA (US); Peter L. Messick, Poquoson, VA (US); Joel A. Alexa, Hampton, VA (US); Edward H. Glaessgen, Yorktown, VA (US); Benjamin T. Hailer, Rome, NY (US)

(73) Assignee: UNITED STATES OF AMERICA AS REPRESENTED BY THE ADMINISTRATOR OF THE NATIONAL AERONAUTICS AND SPACE ADMINISTRATION, Washington, DC (US)

( * ) Notice: Subject to any disclaimer, the term of this patent is extended or adjusted under 35 U.S.C. 154(b) by 1548 days.

(21) Appl. No.: 12/685,280

(22) Filed: Jan. 11, 2010

(65) Prior Publication Data

US 2010/0190026 A1 Jul. 29, 2010

Related U.S. Application Data

(60) Provisional application No. 61/143,481, filed on Jan. 9, 2009.

(51) Int. Cl.

| | |
|---|---|
| ***B32B 15/00*** | (2006.01) |
| ***C22C 1/04*** | (2006.01) |
| ***B22F 5/00*** | (2006.01) |

(52) U.S. Cl.

CPC ..... *C22C 1/0416* (2013.01); *B22F 5/006* (2013.01); *B22F 2998/00* (2013.01); *B22F 2999/00* (2013.01); *Y10T 428/12132* (2015.01)

(58) Field of Classification Search

USPC ..... 428/546, 553, 567, 651

See application file for complete search history.

(56) References Cited

U.S. PATENT DOCUMENTS 5,209,568 A * 5/1993 Buffard et al. ..... 374/49
5,508,116 A * 4/1996 Barrett ..... 428/567

(Continued)

OTHER PUBLICATIONS

Yi et al., "Fracture toughening mechanism of shape memory alloys due to martensite transformation", Sep. 18, 2000, Int'l J. of Solids and Structures, vol. 37, Issue 38, pp. 5315-5327.*

Porter et al., ("Fatigue and fracture behavior of nickel-titanium shape-memory alloy reinforced aluminum composites"), 2001, Materials Science and Engineering, vol. A314, pp. 186-193.*

(Continued)

*Primary Examiner* — David Sample
*Assistant Examiner* — Lucas Wang
(74) *Attorney, Agent, or Firm* — Robin W. Edwards; Andrea Z. Warmbier

(57) ABSTRACT

A composite material includes a structural material and a shape-memory alloy embedded in the structural material. The shape-memory alloy changes crystallographic phase from austenite to martensite in response to a predefined critical macroscopic average strain of the composite material. In a second embodiment, the composite material includes a plurality of particles of a ferromagnetic shape-memory alloy embedded in the structural material. The ferromagnetic shape-memory alloy changes crystallographic phase from austenite to martensite and changes magnetic phase in response to the predefined critical macroscopic average strain of the composite material. A method of forming a composite material for sensing the predefined critical macroscopic average strain includes providing the shape-memory alloy having an austenite crystallographic phase, changing a size and shape of the shape-memory alloy to thereby form a plurality of particles, and combining the structural material and the particles at a temperature of from about 100-700° C. to form the composite material.

36 Claims, 4 Drawing Sheets

(56) References Cited

U.S. PATENT DOCUMENTS

| | | | | |
|---|---|---|---|---|
| 6,200,643 | B1 * | 3/2001 | Sugai et al. | 427/475 |
| 7,393,595 | B2 * | 7/2008 | Chandrasekaran et al. | 428/614 |
| 2003/0221411 | A1 * | 12/2003 | Nesbitt et al. | 60/204 |
| 2011/0008643 | A1 * | 1/2011 | Shaw et al. | 428/592 |

OTHER PUBLICATIONS

Liu et al., "An Investigation on the Interface in a NiTi Short-Fiber-Reinforced 6061 Aluminum Composite by Transmission Electron Microscope", Nov. 2008, Metallurgical and Materials Transactions A, vol. 39A, pp. 2749-2759.*

* cited by examiner

STRAIN-DETECTING COMPOSITE MATERIALS

CROSS-REFERENCE TO RELATED APPLICATIONS

This application claims the benefit of U.S. Provisional Patent Application No. 61/143,481, filed on Jan. 9, 2009, which is hereby incorporated by reference in its entirety.

This invention was made in part by employees of the United States Government and may be manufactured and used by or for the Government of the United States of America for governmental purposes without the payment of any royalties thereon or therefor.

TECHNICAL FIELD

The present invention generally relates to composite materials, and more specifically, to strain-detecting composite materials.

BACKGROUND OF THE INVENTION

Nondestructive evaluation (NDE) techniques are generally useful for evaluating properties of a material without causing damage to the material. For example, NDE techniques are often used to detect overload strain, fatigue damage, and/or localized strain in structural components of airframes. In particular, NDE techniques including fiber optic strain sensing and resistance strain gages may be useful for mapping strain fields in such components. Other NDE techniques based on eddy currents and electromagnetic induction may also non-invasively detect real-time fatigue and/or failure without disturbing the airframe and/or component. Acoustic monitoring, another NDE technique, may also be useful for detecting acoustic emissions produced within a material under strain. Alternatively, giant magneto resistance sensors may be used to measure magnetic fields and magnetic properties of materials. Existing efforts to improve strain-detection focus on improvements in the aforementioned NDE techniques, rather than on the response of the material of the structural component.

SUMMARY OF THE INVENTION

The composite material includes a structural material and a shape-memory alloy embedded in the structural material. The shape-memory alloy changes crystallographic phase from austenite to martensite in response to a predefined critical macroscopic average strain of the composite material.

In a second embodiment, the composite material includes a plurality of particles of a ferromagnetic shape-memory alloy embedded in the structural material. The ferromagnetic shape-memory alloy changes crystallographic phase from austenite to martensite and changes magnetic phase in response to the predefined critical macroscopic average strain of the composite material.

A method of forming a composite material for sensing a predefined critical macroscopic average strain includes providing the structural material in powder form and providing the shape-memory alloy having an austenite crystallographic phase. The shape-memory alloy changes crystallographic phase from austenite to martensite in response to the predefined critical macroscopic average strain of the composite material. The method also includes changing a size and shape of the shape-memory alloy to thereby form a plurality of particles and combining the structural material and the plurality of particles of the shape-memory alloy at a temperature of from about 100° C. to about 700° C. to thereby form the composite material including the plurality of particles embedded in the structural material.

The methods provide composite materials that optimize existing nondestructive evaluation (NDE) techniques for detecting strain of airframes and/or components thereof. That is, the composite materials allow proactive, rather than reactive, strain-detection. Additionally, the composite materials allow for both ground-based and in-flight inspection. Therefore, the composite materials minimize costly and time-consuming detailed inspections and down-time of airframes and structural components, and minimize premature component replacement. Further, the composite materials minimize aircraft complexity and weight, and allow for detection of comparatively smaller strain at comparatively earlier stages of fatigue than existing composite or structural materials. The composite materials may also reduce existing airframe design constraints, since physical access to each component of the airframe stain-detection may no longer be necessary. Such reduced design constraints may allow for comparatively larger payloads, increased service life, and less restriction on mission requirements as compared to airframes formed from existing composite or structural materials.

The above features and advantages and other features and advantages of the present invention are readily apparent from the following detailed description of the best modes for carrying out the invention when taken in connection with the accompanying drawings.

DETAILED DESCRIPTION OF THE INVENTION

Figure 1:
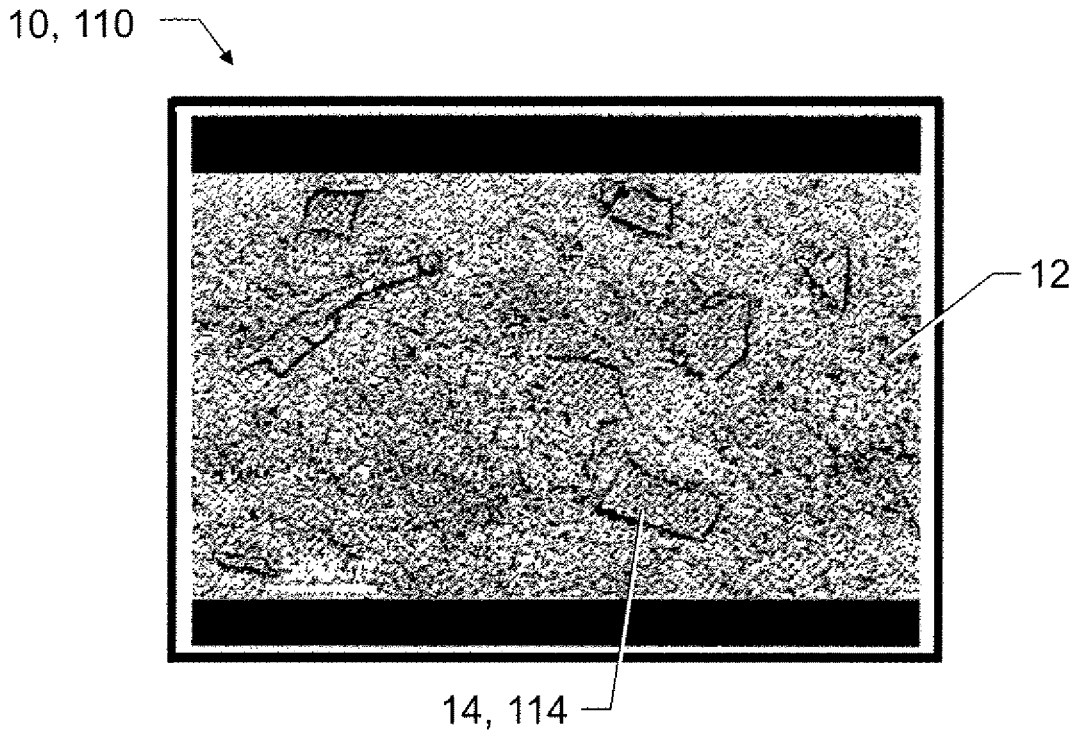
FIG. 1 is a reproduction of an optical micrograph of a cross-section of a composite material.

Referring to the drawings, wherein like reference numerals refer to like components, a composite material is shown generally at 10 in FIG. 1. The composite material 10 may be useful for aeronautical and aerospace applications, such as airframes and/or structural components thereof. For example, the composite material 10 may be a metal, and may form at least a portion of an airframe, such as, but not limited to, a fuselage, a load-bearing strut, and/or a wing. However, it is to be appreciated that the composite material 10 may also be useful for other applications, such as, but not limited to, construction, rail, automotive, and marine applications.

Referring to FIG. 1, the composite material 10 includes a structural material 12. As used herein, the terminology "structural material" refers to ceramics, polymers, alloys, i.e., partial or complete solid solutions of one or more elements in a metallic matrix, and any combinations of ceramics, polymers, and alloys which are useful for structural applications. That is, the structural material 12 may be, for example, a non-magnetic metal, and may possess sufficient strength and malleability to be useful for forming airframes and/or structural components thereof, such as, but not limited to, struts, 1-beams, supports, and the like. Suitable structural materials include, but are not limited to, structural magnesium alloys, structural aluminum alloys, structural steel alloys, and combinations thereof.

A skilled artisan generally selects the structural material 12 according to a desired application and expected strain and/or loading of the composite material 10. That is, a structural component and/or airframe formed from the composite material 10 may be subject to stress, which is a load applied to a unit area of the composite material 10. Exemplary stress applied to the composite material 10 may be characterized as tension, compression, torsion, shear, bending, and combinations thereof, and may be cycling, monotonic, and combinations thereof. Such stress produces a strain, i.e., a deformation deflection gradient in the composite material 10. Further, at a critical macroscopic average strain $c_c$, the stress typically induces a crack, fissure, plastic deformation, wear, breakage, fatigue, or other damage signal in the structural component. Therefore, for airframe applications, the structural material 12 may be selected based on an ability to withstand in-flight and/or ground-based strain. Generally, the structural material 12 may have a yield strength of from about 100 to about 1,000 MPa.

The structural material 12 may be present in the composite material 10 in an amount of at least 40 parts by volume based on 100 parts by volume of the composite material 10. For example, the structural material 12 may be present in the composite material 10 in an amount of 90 parts by volume based on 100 parts by volume of the composite material.

The structural material 12 may be formed of, i.e., alloyed from, any suitable constituent. For example, the structural material 12 may include metallic alloys such as beryllium, titanium, nickel, copper, iron, carbon, manganese, chromium, vanadium, tungsten, zinc, magnesium, silicon, and combinations thereof. In one example, the structural material 12 may be aluminum. Particular suitable aluminum structural materials include, but are not limited to, 7075 aluminum, 6061 aluminum, 6063 aluminum, 2024 aluminum, and 5052 aluminum.

Referring again to FIG. 1, the composite material 10 includes a shape-memory alloy 14 embedded in the structural material 12. As used herein, the terminology "shape-memory alloy" refers to alloys which exhibit a shape-memory effect. That is, the shape-memory alloy 14 may undergo a solid state phase change via molecular rearrangement to shift between a martensite phase, i.e., "martensite", and an austenite phase, i.e., "austenite". Stated differently, the shape-memory alloy 14 may undergo a displacive transformation rather than a diffusional transformation to shift between martensite and austenite. In general, the martensite phase refers to the comparatively lower temperature phase and is often more deformable than the comparatively higher temperature austenite phase. As the shape-memory alloy 14 is cooled, molecules of the shape-memory alloy 14 rearrange from a body-centered cubic arrangement, i.e., the austenite phase, to a face-centered cubic, tetragonal, or hexagonal arrangement, i.e., the martensite phase. The temperature at which the shape-memory alloy 14 begins to change from the austenite phase to the martensite phase is known as the martensite start temperature, $M_s$. The temperature at which the shape-memory alloy 14 completes the change from the austenite phase to the martensite phase is known as the martensite finish temperature, $M_f$. Similarly, as the shape-memory alloy 14 is heated, the temperature at which the shape-memory alloy 14 begins to change from the martensite phase to the austenite phase is known as the austenite start temperature, $A_s$. The temperature at which the shape-memory alloy 14 completes the change from the martensite phase to the austenite phase is known as the austenite finish temperature, $A_f$.

Although the shape-memory alloy 14 changes crystallographic phase in response to temperature, the transformation, i.e., the change in crystallographic phase, may also be a function of strain of the shape-memory alloy 14, as set forth in more detail below. The shape-memory alloy 14 may be present in the composite material 10 for strain-detection. That is, the shape-memory alloy 14 may undergo a crystallographic phase change upon exposure to strain. Non-destructive evaluation (NDE) techniques such as acoustic monitoring, fiber optic strain sensing, eddy current techniques based on electromagnetic induction, and/or giant magneto resistance sensing may detect the crystallographic phase change, as set forth in more detail below.

The shape-memory alloy 14 may be present in the composite material 10 in an amount of from about 5 to about 60 parts by volume based on 100 parts by volume of the composite material 10. For example, the shape-memory alloy 14 may be present in the composite material 10 in an amount of less than or equal to about 25 parts by volume, generally about 10 parts by volume, based on 100 parts by volume of the composite material 10.

The shape-memory alloy 14 may include an element selected from the group of cobalt, nickel, titanium, indium, manganese, iron, palladium, zinc, copper, silver, gold, cadmium, tin, silicon, platinum, gallium, and combinations thereof. For example, suitable shape-memory alloys 14 may include nickel-titanium alloys, nickel-cobalt-aluminum alloys, copper alloys, nickel-manganese-gallium, and the like. Suitable shape-memory alloys 14 may be binary, tertiary, or any order as long as the shape-memory alloy 14 may change from austenite to martensite, as set forth in more detail below. A skilled artisan may select the shape-memory alloy 14 according to desired operating temperatures of the composite material 10, also as set forth in more detail below.

Referring again to FIG. 1, the shape-memory alloy 14 may be present in the composite material 10 in the form of particles, e.g., a plurality of particles. The particles of the shape-memory alloy 14 may have any suitable shape. For example, the particles may be irregularly-shaped. The particles may be circular, spherical, flat, folded, ellipsoidal, crenulated, rectangular, oval, triangular, and combinations thereof. Further, the particles may have any suitable form. For example, the particles may be present in the composite material 10 in disk-, flake-, pellet-, fiber- and/or powder-form.

Referring to FIG. 1, the shape-memory alloy 14 is embedded in the structural material 12. That is, the structural material 12 may at least partially encapsulate and surround the shape-memory alloy 14. It is to be appreciated, however, that one or more particles of the shape-memory alloy 14 may protrude through a visible edge of the composite material 10, e.g., when the composite material 10 is initially formed and/or cross-sectioned. Additionally, the particles may have any orientation within the structural material 12, and the particles may have any suitable size. In one variation, the particles of the shape-memory alloy 14 may have an average particle diameter of from about 10 to about 100 μm. It is to be appreciated that the size, shape, and/or orientation of each particle may be the same or different than the size, shape, and/or orientation of another particle.

The shape-memory alloy 14 may be substantially chemically bonded to the structural material 12. That is, the shape-memory alloy 14 may not only be mechanically bonded to the structural material 12, i.e., adjacent to and in contact with the structural material 12, but may also be substantially chemically bonded to the structural material 12. Stated differently, the shape-memory alloy 14 may form chemical bonds with the surrounding structural material 12 in the composite material 10. Without intending to be limited by theory, chemical bonding between the structural material 12 and the shape-memory alloy 14 may minimize debonding and imperfect mechanical bonds that affect an internal strain distribution of a particle when the particle is exposed to increasing strain. Such internal strain distribution of a particle affects a volume of the particle undergoing a crystallographic phase change under a given strain. Although each particle of the shape-memory alloy 14 is preferably substantially chemically bonded to the structural material 12, it is to be appreciated that some particles may also be partially debonded to the structural material 12.

In operation, i.e., for strain-detection, the shape-memory alloy 14 changes crystallographic phase from austenite to martensite in response to a predefined critical macroscopic average strain $\epsilon_c$ of the composite material 10. As used herein, the terminology "predefined critical macroscopic average strain" is a value of strain sufficient to induce deformation and/or failure in a component formed from the composite material 10 that is subjected to either monotonic or cycling loading. For example, the predefined critical macroscopic average strain $\epsilon_c$ may be a value of strain known to cause cracks, fissures, plastic deformation, wear, breakage, fatigue, and/or other damage in a structural component and/or airframe formed from the composite material 10.

More specifically, the predefined critical macroscopic average strain $\epsilon_c$ may occur, i.e., may be applied to the composite material 10, at a temperature, T, of greater than or equal to about the martensite start temperature, $M_s$, of the shape-memory alloy 14 and less than about the austenite start temperature, $A_s$, of the shape-memory alloy 14. That is, the shape-memory alloy 14 may generally be in the austenitic phase for a range of loads, and corresponding strain values, applied to the composite material 10.

Figure 2:
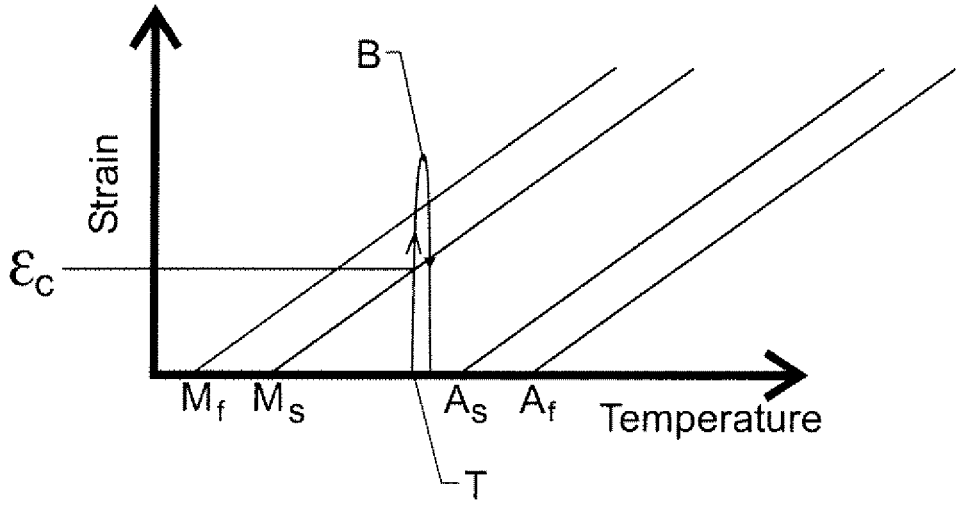
FIG. 2 is a graphical representation of a relationship between strain and temperature for a shape-memory alloy of the composite material of FIG. 1.

However, referring to FIG. 2, as the strain (indicated by arrow B) increases to the predefined critical macroscopic average strain (indicated by point $\epsilon_c$) at the martensite start temperature, $M_s$, of the shape-memory alloy 14 (FIG. 1), the shape-memory alloy 14 transforms, i.e., changes crystallographic phase, from austenite to martensite in response to the predefined critical macroscopic average strain $\epsilon_c$. That is, at the predefined critical macroscopic average strain $\epsilon_c$, the temperature, T, at which the load is applied is greater than or equal to the martensite start temperature, $M_s$, and the shape-memory alloy 14 transforms to martensite. Suitable temperatures, T, at which the load may be applied range from about −150° F. to about 500° F. For example, for airframes and/or components thereof, the composite material 10 may change crystallographic phase in response to the predefined critical macroscopic average strain $\epsilon_c$ applied at a temperature, T, of from about −40° F. to about 150° F.

Upon transformation from austenite to martensite at the predefined critical macroscopic average strain $\epsilon_c$, the shape-memory alloy 14 may generate an acoustic emission in response to the predefined critical macroscopic average strain, $\epsilon_c$. The acoustic emission is a phenomenon whereby external stimuli, e.g., loading, generates elastic waves. Acoustic emissions generally occur during a surface displacement of the composite material 10 due to energy waves generated upon a rapid release of localized stress energy of the shape-memory alloy 14. Therefore, acoustic emissions are a type of signature given off by the shape-memory alloy 14 upon loading to the predefined critical macroscopic average strain $\epsilon_c$ that may be measured and/or monitored by NDE techniques such as acoustic monitoring.

In particular, the shape-memory alloy 14 may generate an acoustic emission in response to the predefined critical macroscopic average strain $\epsilon_c$ that is greater in magnitude than an acoustic emission of the structural material 12. That is, the presence of the particles of the shape-memory alloy 14 may not affect the structural characteristics and/or crystallographic phase of the structural material 12. Stated differently, the structural material 12 may not change crystallographic phase in response to the predefined critical macroscopic average strain $\epsilon_c$.

Figure 3:
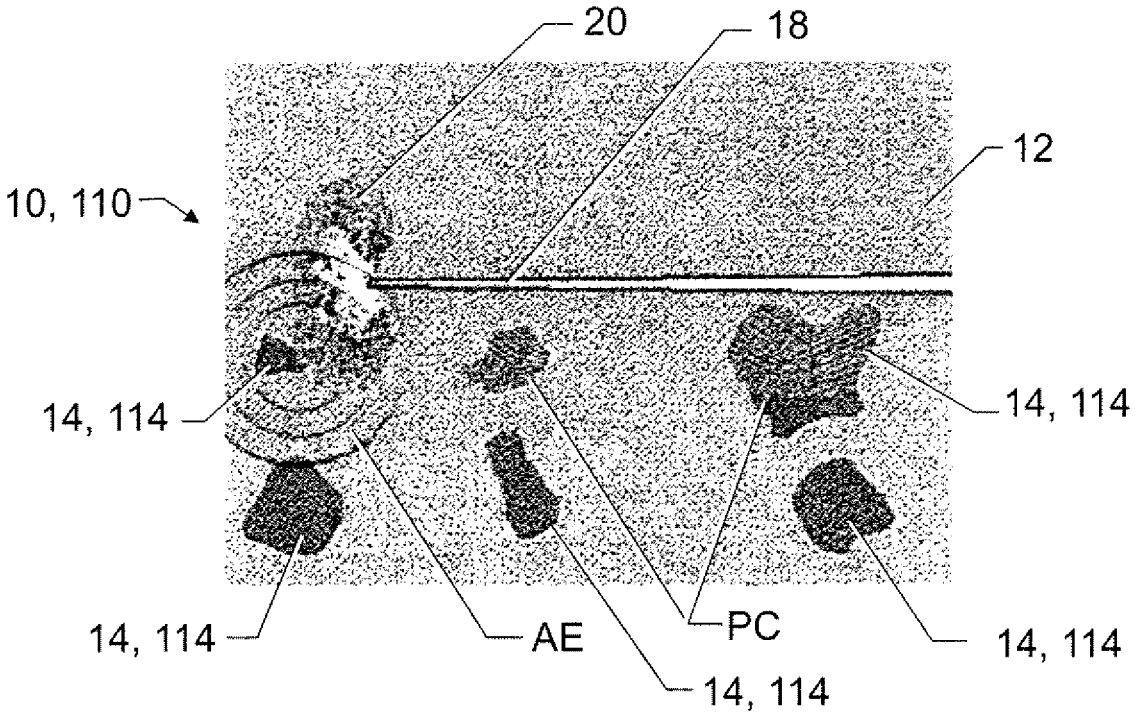
FIG. 3 is an illustration of a response of the shape-memory alloy to a crack in the composite material of FIG. 1 in response to a predefined critical macroscopic average strain.

Referring to FIG. 3, acoustic monitoring may then detect the acoustic emission of the shape-memory alloy 14 to locate, for example, a growth of a crack 18 formed in the composite material 10 due to a previously-applied or presently-applied load that generates a strain at or above the predefined critical macroscopic average strain $\epsilon_c$. For example, and with reference to FIG. 3, as the crack 18 forms in the composite material 10 in response to the predefined critical macroscopic average strain $\epsilon_c$, the crack 18 advances at a crack tip process zone 20. Particles of the shape-memory alloy 14 within the crack tip process zone 20 may undergo the crystallographic phase change from austenite to martensite and generate the acoustic emission, indicated by concentric circles AE in FIG. 3. Therefore, the crystallographic phase change of the shape-memory alloy 14 in the composite material 10 indicates that the predefined critical macroscopic average strain $\epsilon_c$ has been reached for the structural component and/or airframe formed from the composite material 10. The acoustic emission AE may then be detected by known NDE acoustic monitoring techniques.

Referring to FIG. 3, it is to be appreciated that at least one, but not necessarily all, of the particles of the shape-memory alloy 14 may change crystallographic phase in response to the predefined critical macroscopic average strain $\epsilon_c$. That is, particles located within or near the crack tip process zone 20, may change crystallographic phase, whereas other particles may not. However, depending on a severity of the crack 18, all particles may change crystallographic phase. Stated differently, the number and location of particles that undergo the crystallographic phase change at the predefined critical macroscopic average strain $\epsilon_c$ may vary as a result of average strain or localized strain gradient, i.e., cracks 18. Referring to FIG. 3, the crack tip process zone 20 may evoke the crystallographic phase change (indicated by cross-hatching PC of the particles of the shape-memory alloy 14 in FIG. 3) in only a localized region near the crack 18, whereas the crystallographic phase of particles outside of the propagating crack tip process zone 20 may remain unchanged.

As set forth above, the acoustic emission AE shown in FIG. 3 may be detected by NDE acoustic monitoring techniques. For example, a sensor on-board an aircraft or spacecraft may detect the acoustic emission AE corresponding to the crystallographic phase change of one or more particles of the shape-memory alloy 14 in-flight, and warn an operator in real-time that the predefined critical macroscopic average strain $\epsilon_c$ has been reached. Likewise, the acoustic emission AE may be recorded for future evaluation and/or ground-based inspection.

Notably, however, the composite material 10 including the shape-memory alloy 14 may also be useful for ground-based inspection of the airframe and/or structural component. That is, with reference to FIG. 3, since the temperature at which the load is applied, T, is greater than or equal to about the martensite start temperature, $M_s$, of the shape-memory alloy 14 and less than about the austenite start temperature, $A_s$, of the shape-memory alloy 14, the shape-memory alloy 14 may not revert to austenite from martensite. That is, referring to FIG. 2, the particles of the shape-memory alloy 14 may remain in the martensite phase upon unloading after the predefined critical macroscopic average strain $\epsilon_c$ is reached, since the temperature at which the load is applied, T, is less than the austenite start temperature, $A_s$, of the shape-memory alloy 14. Therefore, a ground-based inspection of the airframe and/or structural component may also indicate that the composite material 10 has been exposed to the predefined critical macroscopic average strain $\epsilon_c$.

Further, in one variation, the shape-memory alloy 114 may be a ferromagnetic shape-memory alloy. That is, without intending to be limited by theory, the ferromagnetic shape-memory alloy 114 may produce a magnetic field and exhibit ferromagnetic properties such as parallel alignment of electrons of the ferromagnetic shape-memory alloy 114 when exposed to a magnetic field. More specifically, ferromagnetism generally results from an internal molecular field that acts on and aligns individual electron spins spontaneously into alignment regions, i.e., domains. Further, unpaired electrons in ferromagnetic materials, e.g., iron, cobalt, and nickel, are generally not in an outermost electron orbital, and are thus shielded from unpaired electrons of other atoms. Such unpaired electrons generally do not align anti-parallel, but rather align in parallel to create a net magnetic moment. Therefore, the ferromagnetic shape-memory alloy 114 may change magnetic state, e.g., from and/or to a paramagnetic state and a ferromagnetic state, upon exposure to the predefined critical macroscopic average strain $\epsilon_c$. Suitable ferromagnetic shape-memory alloys may include, but are not limited to, CoNiAl, $Ni_2MnGa$, $Ni_2MnAl$, Fe—Pd, $Fe_3Pt$, NiTi, CuZnAl, CuAlNi, and combinations thereof.

In a second embodiment, the composite material 110 includes the structural material 12 and a plurality of particles of the ferromagnetic shape-memory alloy 114 embedded in the structural material 12. In this embodiment, the ferromagnetic shape-memory alloy 114 changes crystallographic phase from austenite to martensite in response to the predefined critical macroscopic average strain $\epsilon_c$ of the composite material 110. As set forth above, the predefined critical macroscopic average strain $\epsilon_c$ may occur at a temperature, T, of greater than or equal to about the martensite start temperature, $M_s$, of the ferromagnetic shape-memory alloy 114 and less than about the austenite start temperature, $A_s$, of the ferromagnetic shape-memory alloy 114. Further, the ferromagnetic shape-memory alloy 114 may not revert to austenite from martensite.

However, in this embodiment, the ferromagnetic shape-memory alloy 114 also changes magnetic phase in response to the predefined critical macroscopic average strain $\epsilon_c$ of the composite material 110. For example, the ferromagnetic shape-memory alloy 114 may change from a paramagnetic phase to a diamagnetic phase in response to the predefined critical macroscopic average strain $\epsilon_c$. That is, without intending to be limited by theory, above a Curie temperature, $T_c$, the ferromagnetic shape-memory alloy 114 is generally magnetic, and below the Curie temperature, $T_c$, the ferromagnetic shape-memory alloy 114 is generally non-magnetic.

If the temperature, T, at which a load corresponding to the predefined critical macroscopic average strain $\epsilon_c$ is increased to the Curie temperature, $T_c$, thermal motion overwhelms any unpaired electron alignment and magnetization may disappear. Likewise, if T is below $T_c$, magnetization may remain after a magnetic field is removed. Because electron alignment is a function of atomic distances, the Curie temperature, $T_c$, is also a function of strain.

Therefore, a composition of the ferromagnetic shape-memory alloy 114 may be selected such that the martensite start temperature, $M_s$, may be approximately equal to the Curie temperature, $T_c$. In particular, for a given composition of the ferromagnetic shape-memory alloy 114, the martensite start temperature, $M_s$, may be below the temperature, T, at which the load is applied for a range of loads. However, at the predefined critical macroscopic average strain $\epsilon_c$, the temperature, T, at which the load is applied may equal the martensite start temperature, $M_s$, of the ferromagnetic shape-memory alloy 114. Therefore, the ferromagnetic shape-memory alloy 114 changes crystallographic phase and magnetic phase in response to the predefined critical macroscopic average strain $\epsilon_c$ of the composite material 110.

Referring again to FIG. 3, upon transformation from austenite to martensite at the predefined critical macroscopic average strain $\epsilon_c$, the ferromagnetic shape-memory alloy 114 changes magnetic phase in response to the predefined critical macroscopic average strain $\epsilon_c$. The magnetic phase change may be measured and/or monitored by NDE techniques such as giant magneto resistance sensing.

In particular, the ferromagnetic shape-memory alloy 114 may change magnetic phase in response to the predefined critical macroscopic average strain $\epsilon_c$, while the surrounding structural material 12 may not change magnetic phase. Referring to FIG. 3, a giant magneto resistance sensor may then detect the magnetic phase change of the ferromagnetic shape-memory alloy 114 to locate, for example, a crack formed in the composite material 110 due to a previously-applied or presently-applied load that generated a strain at or above the predefined critical macroscopic average strain $\epsilon_c$. For example, with reference to FIG. 3 and as set forth above, as the crack 18 forms in the composite material 110 in response to the predefined critical macroscopic average strain $\epsilon_c$, the crack 18 advances at the crack tip process zone 20. Particles of the ferromagnetic shape-memory alloy 114 within the crack tip process zone 20 may undergo the magnetic phase change, indicated by cross-hatching PC in FIG. 3. Therefore, the magnetic phase change of the ferromagnetic shape-memory alloy 114 in the composite material 110 indicates that the predefined critical macroscopic average strain $\epsilon_c$, has been reached for the structural component and/or airframe formed from the composite material 110. The magnetic phase change may then be detected by known NDE monitoring techniques, such as giant magneto resistance sensing.

Referring to FIG. 3, it is to be appreciated that at least one, but not all, of the particles of the ferromagnetic shape-memory alloy 114 may change magnetic phase in response to the predefined critical macroscopic average strain $\epsilon_c$. That is, particles located within or near the crack tip process zone 20, may change magnetic phase, while other particles may not. However, depending on a severity of a strain field associated with the crack 18, all particles may change magnetic phase. Stated differently, the number and location of particles that undergo the magnetic phase change at the predefined critical macroscopic average strain $\epsilon_c$ may vary as a result of localized strain gradient, i.e., cracks 18. Referring to FIG. 3, the crack tip process zone 20 may evoke the magnetic phase change in only a localized region, indicated by cross-hatching PC of the particles, near the crack 18, whereas the crystallographic phase of particles outside of the propagating crack tip process zone 20 may remain unchanged.

As set forth above, the magnetic phase change indicated in FIG. 3 may be detected by NDE sensing techniques. For example, a sensor on-board an aircraft or spacecraft may detect the magnetic phase change corresponding to the predefined critical macroscopic average strain $\epsilon_c$ of one or more particles of the ferromagnetic shape-memory alloy 114 in flight and warn an operator that the predefined critical macroscopic average strain $\epsilon_c$ has been reached. Likewise, the composite material 110 including the ferromagnetic shape-memory alloy 114 may also be useful for ground-based inspection of the airframe and/or structural component.

In a specific example, the composite material 110 may include aluminum and a plurality of CoNiAl particles embedded in the aluminum. The CoNiAl particles are present in the composite material 110 in an amount of about 10 parts by volume based on 100 parts by volume of the composite material 110, so as to provide strain-sensing properties to the composite material 110. Further, at least one of the CoNiAl particles changes crystallographic phase from austenite to martensite and changes magnetic phase upon exposure to the predefined critical macroscopic average strain $\epsilon_c$ applied at a temperature. T, of greater than or equal to about the martensite start temperature, $M_s$, of the CoNiAl and less than about an austenite start temperature, $A_s$, of the CoNiAl. Further, the composite material 110 may not revert to austenite from martensite, and the CoNiAl may generate an acoustic emission in response to the predefined critical macroscopic average strain $\epsilon_c$ that is greater in magnitude than an acoustic emission of the aluminum.

Referring again to FIG. 3, a composite material 10, 110 for sensing the predefined critical macroscopic average strain $\epsilon_c$ in structural applications includes the structural material 12. The composite material 10, 110 also includes the shape-memory alloy 14 having a characteristic of generating a signal AE, PC in response to a martensitic transformation. The shape-memory alloy 14, which may be the ferromagnetic shape-memory alloy 114, is embedded in the structural material 12 so that a structural characteristic of the structural material 12. e.g., a strength or ductility, is not adversely affected. That is, the presence of the shape-memory alloy 14 does not adversely affect the structural characteristic of the structural material 12.

The shape-memory alloy 14 may be substantially chemically bonded to the structural material 12 when embedded in the structural material 12. Further, a configuration of the shape-memory alloy 14 may influence a load transfer from the structural material 12 to the shape-memory alloy 14. That is, the configuration of the shape-memory alloy 14 may influence how the load applied to the composite material 10, 110 is transferred between the structural material 12 and the shape-memory alloy 14. The configuration of the shape-memory alloy 14, for example, may be at least one of ellipsoidal and crenulated in shape. Such shapes may optimize the load transfer from the structural material 12 to the shape-memory alloy 14 to minimize cracking at boundaries between the structural material 12 and the shape-memory alloy 14.

Referring generally to FIG. 3, the shape-memory alloy 14 undergoes the martensitic transformation within the composite material 10, 110 in response to the predefined critical macroscopic average strain $\epsilon_c$ of the composite material 10, 110 to generate the signal AE, PC that is different from, e.g., of greater intensity than, the signal generatable from a material that is substantially free from the shape-memory alloy 14. That is, the signal, e.g., the acoustic emission AE and/or the crystallographic or magnetic phase change PC, is different from any signal generatable from a composite or structural material that does not include the shape-memory alloy 14. For example, the signal AE, PC may be greater in magnitude than any signal generatable from a composite or structural material that does not include the shape-memory alloy 14. Therefore, the shape-memory alloy 14 generates, for example, the acoustic emission AE that is detectable in response to the predefined critical macroscopic average strain $\epsilon_c$ of the composite material 10, 110.

A method of forming the composite material 10, 110 for sensing the predefined critical macroscopic average strain $\epsilon_c$ includes providing the structural material 12 in powder form. That is, the structural material 12 may be in the form of loose particles having an average size of from about 100 μm to about 1,400 μm formed by any suitable method. For example, the structural material 12 may be comminuted via milling or grinding to provide the powder form.

The method further includes providing the shape-memory alloy 14, which may be the ferromagnetic shape-memory alloy 114, having the austenite crystallographic phase. As set forth above, the shape-memory alloy 14 changes crystallographic phase from austenite to martensite in response to the predefined critical macroscopic average strain $\epsilon_c$ of the composite material 10, 110. By way of example, the shape-memory alloy 14 may be initially provided in the form of an ingot, a block, a wafer, or a disc having an initial crystallographic phase after emerging from an induction furnace. The shape-memory alloy 14 having the austenite crystallographic phase may then be provided by heat treating the shape-memory alloy 14 at a temperature of from about 1000° C. to about 1500° C., e.g., at about 1300° C., for from about 1 to about 4 hours to change the initial crystallographic phase to austenite. The shape-memory alloy 14 may then be water quenched to room temperature to provide the shape-memory alloy 14 having the austenite crystallographic phase.

The method further includes changing a size and shape of the shape-memory alloy 14 to thereby form the plurality of particles of the shape-memory alloy 14. The size of the particles may be reduced and the shape of the particles may be changed by any suitable method. For example, changing a size and shape may include grinding the shape-memory alloy 14 to form the plurality of particles. In other examples, the size and shape of the shape-memory alloy 14 may be changed by splat-cooling, gas atomizing, pulverizing, and/or plasma spraying.

The method also includes combining the structural material 12 and the plurality of particles of the shape-memory alloy 14 at a temperature of from about 500° C. to about 700° C. to thereby form the composite material 10, 110 including the plurality of particles embedded in the structural material 12. More specifically, the structural material 12 in powder form and the plurality of particles of the shape-memory alloy 14 may be combined in any order to form a mixture. In one example, the mixture may be vacuum hot pressed at a temperature of from about 500° C. to about 700° C. and a pressure of from about 10 ksi (kilopound per square inch) to about 20 ksi for from about 10 to about 20 minutes. More specifically, the mixture may be vacuum hot pressed in a suitable vacuum hot pressing apparatus at a temperature of about 625° C. and a pressure of about 15 ksi for about 15 minutes to form the composite material 10, 110.

In another example, the mixture may be hot rolled at a temperature of from about 100° C. to about 200° C. to form the composite material 10, 110. More specifically, the mixture of the structural material 12 and the plurality of particles of the shape-memory alloy 14 may be vacuum sealed in a stainless steel bag and heated to a temperature of about 150° C. The stainless steel bag containing the mixture may then be rolled by a roller of a suitable hot rolling apparatus to form the composite material 10, 110.

For the method, processing parameters set forth above such as pressures, temperatures, order of addition, and particle sizes may be selected to optimize a microstructure of the composite material 10, 110. For example, variations in the microstructure of the composite material 10, 110 that can be influenced by the processing parameters include particle size of the structural material 12, crystallographic phase formation within the structural material 12, retention of the shape-memory behavior of the shape-memory alloy 14, and chemical reaction or diffusion between the shape-memory alloy 14 and the structural material 12.

The methods provide composite materials 10, 110 that optimize existing nondestructive evaluation (NDE) techniques for detecting strain of airframes and/or components thereof. That is, the composite materials 10, 110 allow proactive, rather than reactive, strain-detection. Additionally, the composite materials 10, 110 allow for both ground-based and in-flight inspection. Therefore, the composite materials 10, 110 minimize costly and time-consuming detailed inspections and down-time of airframes and structural components, and minimize premature component replacement. Further, the composite materials 10, 110 minimize aircraft complexity and weight, and allow for detection of comparatively smaller strain at comparatively earlier stages of fatigue than existing composite or structural materials. The composite materials 10, 110 may also reduce existing airframe design constraints, since physical access to each component of the airframe for strain-detection may no longer be necessary. Such reduced design constraints may allow for comparatively larger payloads, increased service life, and less restriction on mission requirements as compared to airframes formed from existing composite or structural materials.

Figure 4:
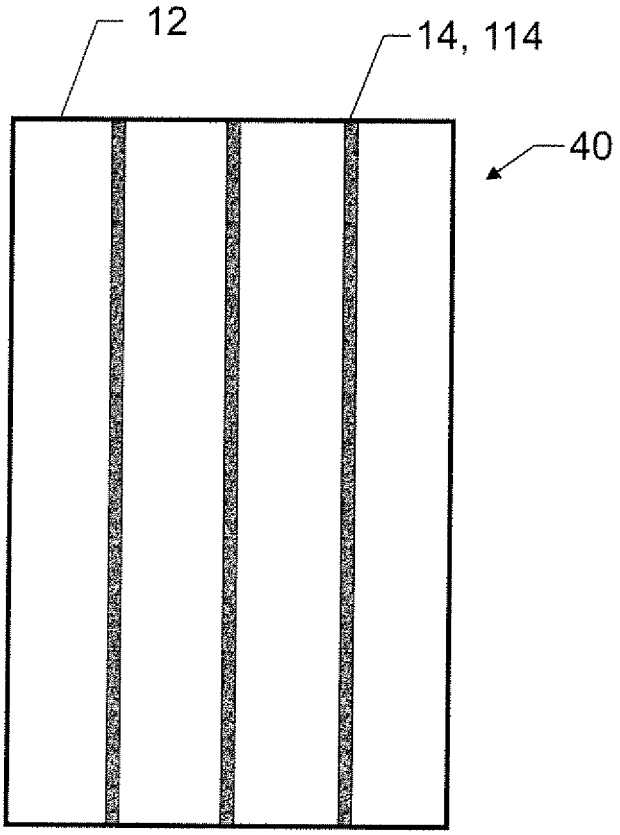
FIG. 4 is an illustration of a laminate embodiment of the composite material.
Figure 5:
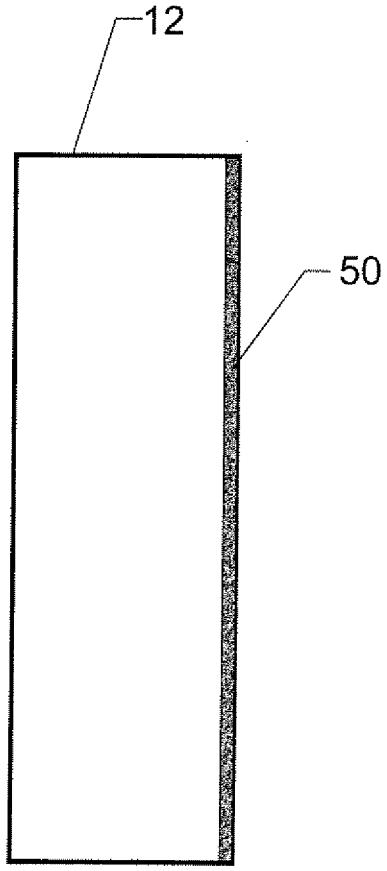
FIG. 5 is an illustration of the shape-memory alloy applied as a coating.
Figure 6:
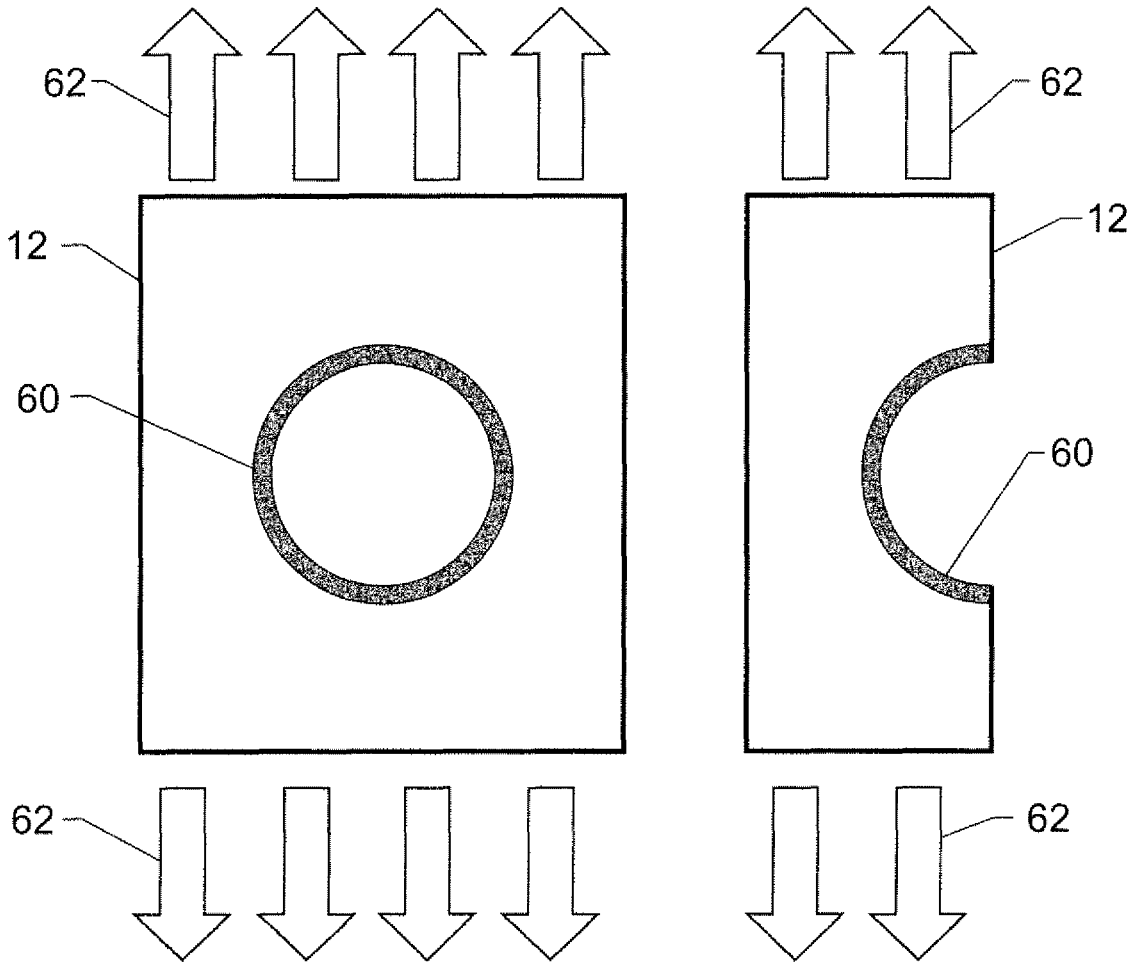
FIG. 6 is an illustration of a shape-memory alloy applied as a coating at areas of high strain concentration.

In further embodiments of the present invention, the shape-memory (non-ferromagnetic or ferromagnetic) alloy 14, 114 may be present in the composite material 10, 110 in a form other than particles. For example, referring to FIG. 4, the shape-memory alloy 14, 114 and structural material 12 can be in laminate form 40, consisting of one or more layers of shape-memory alloy 14, 114 and structural material 12, or the shape-memory alloy 14, 114 can be a coating 50 on the structural material 12, as shown in FIG. 5. The coating 50 may be applied to the entire structural material 12 or to selected areas of interest such as regions of high strain concentration 60, as shown in FIG. 6. Such configurations where local strains are elevated due to applied stress 62 include, but are not limited to, hole inside diameter, fillet, and notch regions as shown in FIG. 6. Each shape-memory alloy layer 14, 114 may be chemically bonded, mechanically bonded, or vapor deposited onto one or more structural materials 12 to produce each laminate 40 or surface coating 50. Each shape-memory alloy layer 14, 114 is at least about 1 nm in thickness with the total volume to be less than that of the structural material 12.

While the best modes for carrying out the invention have been described in detail, those familiar with the art to which this invention relates will recognize various alternative designs and embodiments for practicing the invention within the scope of the appended claims.

What is claimed as new and desired to be secured by Letters Patent of the United States is:

1. A composite material comprising:

a structural material; and a plurality of particles formed from a shape-memory alloy and embedded in said structural material such that the ductility of the structural material is not adversely affected;

wherein the composite material is configured such that when a crack forms in the composite material with a crack tip process zone at a tip of the crack and an adjacent region disposed adjacent to said crack tip process zone, such that when the crack tip process zone reaches one of the plurality of particles formed from the shape-memory alloy, said shape-memory alloy within said crack tip process zone changes crystallographic phase from austenite to martensite within said crack tip process zone in response to a predefined critical macroscopic average strain within said crack tip process zone, and wherein a strain in said adjacent region is below the predefined critical macroscopic average strain, and said shape-memory alloy within said adjacent region does not change crystallographic phase from austenite to martensite within said adjacent region; and wherein said shape-memory alloy having a changed crystallographic phase from austenite to martensite does not revert to austenite from martensite upon removal of said predefined critical macroscopic average strain.

2. The composite material of claim 1, wherein said predefined critical macroscopic average strain occurs at a temperature of greater than or equal to about a martensite start temperature, $M_s$, of said shape-memory alloy and less than about an austenite start temperature, $A_s$, of said shape-memory alloy.

3. The composite material of claim 1, wherein said structural material is present in said composite material in an amount of at least 40 parts by volume based on 100 parts by volume of said composite material.

4. The composite material of claim 1, wherein said shape-memory alloy is present in said composite material in an amount of less than or equal to about 25 parts by volume based on 100 parts by volume of said composite material.

5. The composite material of claim 1, wherein said shape-memory alloy generates an acoustic emission in response to said predefined critical macroscopic average strain that is greater in magnitude than an acoustic emission of said structural material.

6. The composite material of claim 1, wherein said shape-memory alloy is substantially chemically bonded to said structural material.

7. The composite material of claim 1, wherein said shape-memory alloy is a ferromagnetic shape-memory alloy.

8. The composite material of claim 7, Wherein said ferromagnetic shape-memory alloy changes magnetic state upon exposure to said predefined critical macroscopic average strain.

9. The composite material of claim 1, wherein said shape-memory alloy includes an element selected from the group of cobalt, nickel, titanium, indium, manganese, iron, palladium, zinc, copper, silver, gold, cadmium, tin, silicon, platinum, gallium, and combinations thereof.

10. The composite material of claim 1, wherein said structural material is a metal.

11. The composite material of claim 10, wherein said structural material is aluminum.

12. The composite material of claim 1, wherein said composite material forms at least a portion of an airframe.

13. A composite material comprising:

a structural material; and a plurality of particles formed from a ferromagnetic shape-memory alloy and embedded in said structural material such that the ductility of the structural material is not adversel affected:

wherein the composite material is configured such that when a crack forms in the composite material with a crack tip process zone at a tip of the crack and an adjacent region disposed adjacent to said crack tip process zone, such that when the crack tip process zone reaches one of the plurality of particles formed from the ferromagnetic shape-memory alloy, said ferromagnetic shape-memory alloy within said crack tip process zone changes crystallographic phase from austenite to martensite within said crack tip process zone and changes magnetic phase within said crack tip process zone in response to a predefined critical macroscopic average strain within said crack tip process zone, and wherein a strain in said adjacent region is below the predefined critical macroscopic average strain, and said ferromagnetic shape-memory alloy within said adjacent region does not change crystallographic phase from austenite to martensite within said adjacent region and does not change magnetic phase within said adjacent region; and wherein said ferromagnetic shape-memory alloy having a changed crystallographic phase from austenite to martensite does not revert to austenite from martensite upon removal of said predefined critical macroscopic average strain.

14. The composite material of claim 13, wherein said predefined critical macroscopic average strain occurs at a temperature of greater than or equal to about a martensite start temperature, $M_s$, of said ferromagnetic shape-memory alloy and less than about an austenite start temperature, $A_s$, of said ferromagnetic shape-memoly alloy.

15. A composite material comprising:

a laminate structure including:

at least one layer formed from a structural material; and a shape-memory alloy embedded in said structural material such that the ductility of the structural material is not adversely affected wherein the composite material is configured such that when a crack forms in the structural material with a crack tip process zone at a tip of the crack, such that the shape memory alloy has a strained region disposed adjacent said crack tip process zone and an adjacent region disposed adjacent to said strained region, wherein when the crack tip process zone reaches the shape-memory alloy, said shape-memory alloy in said strained region changes crystallographic phase from austenite to martensite within said strained region in response to a predefined critical macroscopic average strain within said strained region, and wherein a strain in said adjacent region is below the predefined critical macroscopic average strain, and said shape-memory alloy in said adjacent region does not change crystallographic phase from austenite to martensite within said adjacent region; and wherein said shape-memory alloy having a changed crystallographic phase from austenite to martensite does not revert to austenite from martensite upon removal of said predefined critical macroscopic average strain.

16. The composite material of claim 15, wherein said predefined critical macroscopic average strain occurs at a temperature of greater than or equal to about a martensite start temperature, $M_s$, of said shape-memory alloy and less than about an austenite start temperature, $A_s$, of said shape-memory alloy.

17. The composite material of claim 15, wherein said shape-memory alloy generates an acoustic emission in response to said predefined critical macroscopic average strain that is greater in magnitude than an acoustic emission of said structural material.

18. The composite material of claim 15, wherein said shape-memory alloy is a ferromagnetic shape-memory alloy.

19. The composite material of claim 18, wherein said ferromagnetic shape-memory alloy changes magnetic state upon exposure to said predefined critical macroscopic average strain.

20. The composite material of claim 15, wherein said shape-memory alloy includes an element selected from the group of cobalt, nickel, titanium, indium, manganese, iron, palladium, zinc, copper, silver, gold, cadmium, tin, silicon, platinum, gallium, and combinations thereof.

21. The composite material of claim 15, wherein said structural material is a metal.

22. The composite material of claim 21, wherein said structural material is aluminum.

23. The composite material of claim 15, wherein said composite material forms at least a portion of an airframe.

24. A composite material comprising:

a structural material; and a plurality of particles formed from a ferromagnetic shape-memory alloy and embedded in said structural material such that the ductility of the structural material is not adversely affected;

wherein the composite material is configured such that when a crack forms in the structural material with a crack tip process zone at a tip of the crack, and such that the shape memory alloy has a strained region disposed adjacent said crack tip process zone and an adjacent region disposed adjacent said strained region, wherein when the crack tip process zone reaches the shape memory alloy, said shape-memory alloy within said strained region changes crystallographic phase from austenite to martensite within said strained region in response to a predefined critical macroscopic average strain within said strained region, and wherein a strain in said adjacent region is below the predefined critical macroscopic average strain, and said shape-memory alloy within said adjacent region does not change crystallographic phase from austenite to martensite within said adjacent region;

wherein said shape-memory alloy having a changed crystallographic phase from austenite to martensite does not revert to austenite from martensite upon removal of said predefined critical macroscopic average strain;

wherein said predefined critical macroscopic average strain occurs at a temperature of greater than or equal to about a martensite start temperature, $M_s$ , of said shape-memory alloy and less than about an austenite start temperature, $A_s$ of said shape-memory alloy; and wherein said shape-memory alloy generates an acoustic emission in response to said predefined critical macroscopic average strain that is greater in magnitude than an acoustic emission of said structural material.

25. The composite material of claim 24, wherein said shape-memory alloy is a ferromagnetic shape-memory alloy.

26. The composite material of claim 25, wherein said ferromagnetic shape-memory alloy changes magnetic state upon exposure to said predefined critical macroscopic average strain.

27. The composite material of claim 24, wherein said shape-memory alloy includes an element selected from the group of cobalt, nickel, titanium, indium, manganese, iron, palladium, zinc, copper, silver, gold, cadmium, tin, silicon, platinum, gallium, and combinations thereof.

28. The composite material of claim 24, wherein said structural material is a metal.

29. The composite material of claim 28, wherein said structural material is aluminum.

30. The composite material of claim 24, wherein said composite material forms at least a portion of an airframe.

31. The composite material of claim 1, wherein each of said plurality of particles is at least one of ellipsoidal and crenulated to thereby transfer said predefined critical macroscopic average strain from said structural material to said shape-memory alloy.

32. The composite material of claim 1, wherein said shape-memory alloy generates an acoustic emission within said crack tip process zone in response to said predetermined critical macroscopic average strain that is greater in magnitude than an acoustic emission of said structural material within said adjacent region.

33. The composite material of claim 15, wherein said shape-memory alloy generates an acoustic emission within said strained region in response to said predetermined critical macroscopic average strain that is greater in magnitude than an acoustic emission of said structural material within said adjacent region.

34. An assembly comprising a structural component formed at least partially from the composite material of claim 32, and an acoustic monitoring device connected to the assembly, wherein the acoustic monitoring device is configured to detect the acoustic emission of said shape memory alloy.

35. An assembly comprising a structural component formed at least partially from the composite material of claim 33, and an acoustic monitoring device connected to the assembly, wherein the acoustic monitoring device is configured to detect the acoustic emission of said shape memory alloy.

36. An assembly comprising a structural component formed at least partially from the composite material of claim 13, and a magnetic monitoring device connected to the assembly, wherein the magnetic monitoring device is configured to detect the change in magnetic phase of said ferromagnetic shape memory alloy.

* * * * *